US010832601B2

(12) United States Patent
Topcuoglu

(10) Patent No.: US 10,832,601 B2
(45) Date of Patent: Nov. 10, 2020

(54) FRAME STAND FOR POSTERS

(71) Applicant: M.T. REKLAM ANONIM SIRKETI, Gebze / Kocaeli (TR)

(72) Inventor: Ali Topcuoglu, Istanbul (TR)

(73) Assignee: M.T Reklam Anonim Sirketi, Gebze/Kocaeli (TR)

( * ) Notice: Subject to any disclaimer, the term of this patent is extended or adjusted under 35 U.S.C. 154(b) by 0 days.

(21) Appl. No.: 16/480,883

(22) PCT Filed: Feb. 8, 2017

(86) PCT No.: PCT/EP2017/052765
§ 371 (c)(1),
(2) Date: Jul. 25, 2019

(87) PCT Pub. No.: WO2018/145741
PCT Pub. Date: Aug. 16, 2018

(65) Prior Publication Data

US 2019/0392738 A1 Dec. 26, 2019

(51) Int. Cl.
*G09F 15/00* (2006.01)

(52) U.S. Cl.
CPC ..... *G09F 15/0062* (2013.01); *G09F 15/0012* (2013.01)

(58) Field of Classification Search
CPC ..... G09F 15/0062; A47G 2001/0666
USPC ..... 40/611.03, 711, 781
See application file for complete search history.

(56) References Cited

U.S. PATENT DOCUMENTS

| | | | | |
|---|---|---|---|---|
| 1,487,500 A | | 3/1924 | Williams | |
| 1,573,264 A | * | 2/1926 | Mankameyer | G09F 15/0012 40/611.03 |
| 2,073,403 A | | 3/1937 | Goldberg | |
| 2,454,648 A | | 11/1948 | Green | |
| 4,949,483 A | * | 8/1990 | Dobson | A47G 1/06 40/740 |
| 6,131,320 A | * | 10/2000 | Eberle | G09F 15/0062 40/606.18 |
| 7,337,569 B2 | | 3/2008 | Glass | |
| 2006/0032098 A1 | | 2/2006 | Glass | |

FOREIGN PATENT DOCUMENTS

DE 203 15 284 U1 12/2003

OTHER PUBLICATIONS

International Search Report in International Patent Application No. PCT/EP2017/052765, dated Sep. 6, 2017 (4 pages).
Written Opinion in International Patent Application No. PCT/EP2017/052765, dated Sep. 6, 2017 (7 pages).

* cited by examiner

*Primary Examiner* — Joanne Silbermann
(74) *Attorney, Agent, or Firm* — Nixon Peabody LLP

(57) ABSTRACT

A frame stand for posters including a base plate (11) and a cover frame (12), characterized in that the cover frame (12) has a bottom edge (122*a*) which is rotatable connected to the base plate (11).

17 Claims, 8 Drawing Sheets

FRAME STAND FOR POSTERS

REFERENCE TO RELATED APPLICATION

This application is a U.S. national stage of PCT/EP2017/052765 filed on Feb. 8, 2017, the contents of which is incorporated herein by reference in its entirety.

TECHNICAL FIELD

The invention relates to a frame stand for posters, especially a V-shape or an A-shape stand frame.

BACKGROUND ART

Display frames are widely used in advertisement, announcement, traffic signs, safety warnings, information bulletins, etc. Generally, a displaying sheet (such as a poster, a sign, a picture, an information sheet, etc.) is attached or inserted in the display frame. And most of the time, the displaying sheet therein needs to be changed from time to time according to different scenarios.

The "poster" is used hereafter as a sample of the displaying sheet which is not limited to pictures or photos but also cover any instructing signs, document sheets, and so on.

A frame stand, which can stand on the ground by itself after assembly, is widely used, because it is easy to be put into use at any place.

Among various frame stands, V-shape frame stands and A-shape frame stands are popular.

A V-shape frame stand may comprise two frames connected together and appears as an inverted "V" when deployed. Generally, the two frames are connected to each other at one end by one or more hinges, permitting the two frames to be folded flat for transportation or storage, and permitting the two frames to be configured in the shape of an inverted "V" when deployed. Sometimes, the frames may have legs to stand on the ground. Some examples of the V-shape frame stands can be seen in U.S. Pat. No. 7,337,569 B2 or US 20110239506 A1.

An A-shape frame stand is similar to the V-shape frame stand, except that a connecting member is placed on the middle or lower part between the two frames. This connecting member may be either a rigid member (like a bar or a rod) or a flexible member (like a rope or a cord or a chain or a strap).

As an example of an A-shape frame stand, two frames are connected via hinges disposed along the top of the respective panels, and the lower portions of the frame can be spread apart. A flexible member is connected between adjacent legs on opposing frames, the flexible member being dimensioned such that the maximum angle between the frames of the sign stand can be restricted.

Some examples of the A-shape frame stands can be seen in U.S. Pat. No. 2,075,401, 6,615,523 B1 or 6,131,320.

US 20110239506 A1 discloses a V-shape frame stand, which has advantages like simple constructions and easy manipulations. However, it also has disadvantages. For example, the poster in display is liable to be contaminated by water and dust. Besides, the size of the poster suitable to be inserted into the frame is limited. It can be expected that only a poster with designated size can be directly inserted into the panel. When the size of the poster is smaller than the displaying area, extra tapes or adhesive would probably be needed to attach the poster on the frame.

U.S. Pat. No. 2,075,401 discloses an A-shape frame stand which comprises a removable frame (17, 18) by which the poster is held in place. In this document, posters can be held in a taut position to present a good appearance. Besides, the posters may be held for display without need of employing any adhesive. However, its manipulation is relatively troublesome, especially when two end bars 18 have to be aligned and inserted into the recesses 16 of the base plate.

SUMMARY OF INVENTION

It is an object of the present invention to provide a frame stand, which can stand on the ground by itself after assembly. It shall be possible to insert a poster in an easy and reliable manner.

The invention provides a frame stand as described in claim 1, while the dependent claims describe preferred characteristics of the invention.

A frame stand for posters according to the main claim comprises a base plate and a cover frame. The cover frame has a bottom edge which is rotatable connected to the base plate. The bottom edge is the edge at the bottom when the frame stand stands on a ground in the intended manner.

The base plate as well as the frame can be formed from plastic or a metal like aluminum.

Due to the rotatable connection, the cover frame can be moved between a closed and an opened position. It is possible to grip a top portion of the frame in order to move the frame by hand which facilitates the handling. Top portion means a portion at the top of the cover frame when the frame stand stands on a ground in the intended manner.

In the opened position, a poster can be inserted between the base plate and the cover frame from the top and thus in an easy and reliable manner. In the closed position, an inserted poster can be held by the base plate and the cover frame in a reliable manner.

In a preferred embodiment, the frame stand comprises a locking mechanism at the top for the cover frame. "Top" refers to the situation when the frame stand stands on a ground in the intended manner. The locking mechanism comprises a locking element to lock the cover frame (12) and the base plate (11) together.

The locking mechanism can lock the cover frame in its closed position. It is not possible to move the cover frame to the opened position, when the cover frame is locked in its closed position.

Preferably, the locking element is capable of locking the upper edge of the cover frame with the base plate in order to facilitate the handling.

In a preferred embodiment of the invention, the locking mechanism is arranged adjacent to a handle of the frame stand. This makes it easier to unlock the locking mechanism.

In a preferred embodiment, a groove is provided in the upper portion of the base plate, and the groove is so arranged that an inner edge of the upper edge of the cover frame can be inserted into the groove for stability reasons.

In a preferred embodiment, the locking element comprises a latch which has a projection suitable to be inserted into a slot of the upper edge of the cover frame. In this way, an appropriate locking mechanism can be realized in a simple manner.

Preferably, the above mentioned inner edge of the upper edge comprises the slot which allows arranging the locking mechanism in a more appropriate manner so that the handling is convenient.

In a preferred embodiment, one end of the latch can move upwardly or downwardly when the frame stand stands on a ground. Due to this embodiment, it is very easy to lock and/or to unlock the locking mechanism.

In a preferred embodiment, the latch is mounted in rotatable manner. Preferably, one end of the latch is mounted in rotatable manner in order to facilitate the handling of the locking mechanism.

In a preferred embodiment, the locking mechanism comprises a pre-stressed spring which can move the locking mechanism into its locked position and/or which can hold the locking mechanism in its locked position.

In a preferred embodiment, the locking mechanism comprises a grip bar which is attached to a latch. Preferably, the grip bar is bent forward or backward relative to the latch and/or the latch and the grip bar forms angle of preferably 90°. The grip facilitates the handling of the locking mechanism.

In a preferred embodiment, a hole is provided on the top portion of the base plate to form a handle for the frame stand, and the hole is so adapted that a user's hand can pass through the hole to lift the latch. On one side, the locking mechanism is covered by at least one plate and thus well-protected. On the other side, it is easy to lock or to unlock the locking mechanism.

In a preferred embodiment of the invention, the base plate comprises a circumferential projection which surrounds the cover frame when the cover frame is in its closed position. Thus, an inserted poster is well-protected.

Preferably, the outer surfaces of the circumferential projection and the cover frame are flush with each other when the cover frame is in its closed position or the circumferential projection stands out against the cover frame. As a result, the cover frame is well-protected.

In a preferred embodiment of the invention, the cover frame surrounds a transparent plate. The plate can protect an inserted poster in addition. The plate can held the poster in addition and thus a more reliable manner independent from the size of the poster. The transparent plate can be formed from plastic or glass.

In a preferred embodiment, the base plate has an inclined display surface when the frame stand stands on the ground. As a result, the cover frame can remain in its closed position only due to gravity. This further facilitates the handling of the frame stand.

In a preferred embodiment, the frame stand is an A- or a V-shape frame stand. The frame stand may comprise two base plates or the above mentioned base plate and a base frame. Such a stand can stand on a ground in a very stable manner.

The two base plates respectively the base plate and the base frame can be connected together by a hinge. In a preferred embodiment, the base plates respectively the base plate and the base frame can swing out to present an inverted "V" or an A.

DETAILED DESCRIPTION OF THE INVENTION

Some exemplary embodiments are described blow with reference to drawings, so that the advantages and characteristics of present invention can be better understood.

Figure 1:
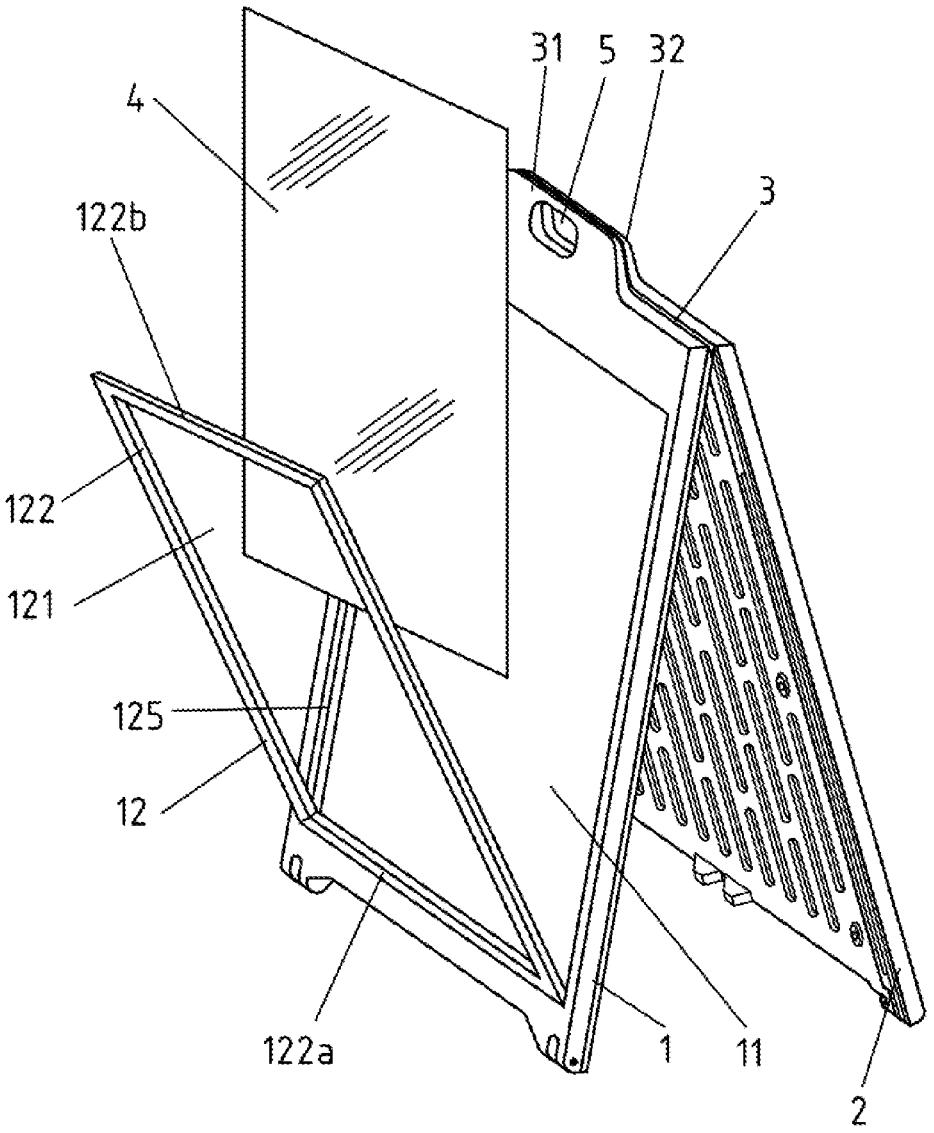
FIG. 1 is a perspective view of a V-shape frame stand according to an embodiment of our invention.

A detailed embodiment of the present invention is illustrated in FIG. 1.

As shown in FIG. 1, a V-shape frame stand comprises two frames 1 and 2, which form an inverted "V" when deployed. The two frames 1 and 2 are hinged on the upper part.

In an example, the two frames 1 and 2 are made of an artificial material and molded in such a shape that the hinge elements on the upper parts of the two base plates can be engaged together, by which the frame stand can be folded or deployed. In another word, hinge elements are integrally molded with the frames. Optionally, extra accessories such as metal axis to connect the molded hinge elements may be used. The first frame 1 surrounds a base plate 11. The second frame may also surround a base plate for example for stability reasons.

As an alternative, separate metal hinges may be used. However, each frame 1 comprising the base plate 11 and hinge elements are preferably made in one piece as shown in the figures.

FIG. 1 shows the frame stand standing on a ground in an intended manner.

In an example, a top portion 31 and 32 is provided on top of the frames 1 and 2 respectively, and located above the hinge elements. Each top portion 31 or 32 has preferably two side edges of an acute angle. When the frames 1 and 2 are rotated around the hinge to form an opening status, the opposing top portions 31 and 32 will come into contact and restrain a further increase in the opening angle, so that the opening angle will be kept to be an acute angle, like a V shape as shown in FIG. 1.

In a preferred example, each top portion 31 and 32 comprises a hole 5, so that the top portions 31 and 32 comprise a handle for the V-shape frame stand. In other words, the holes 5 form a handle.

Many other known constructions to form a V-shape frame stand, such as described in U.S. Pat. No. 7,337,569 B2, US20110239506A1, etc., may also be applied to our present invention as an alternative to the above examples.

Figure 2A:
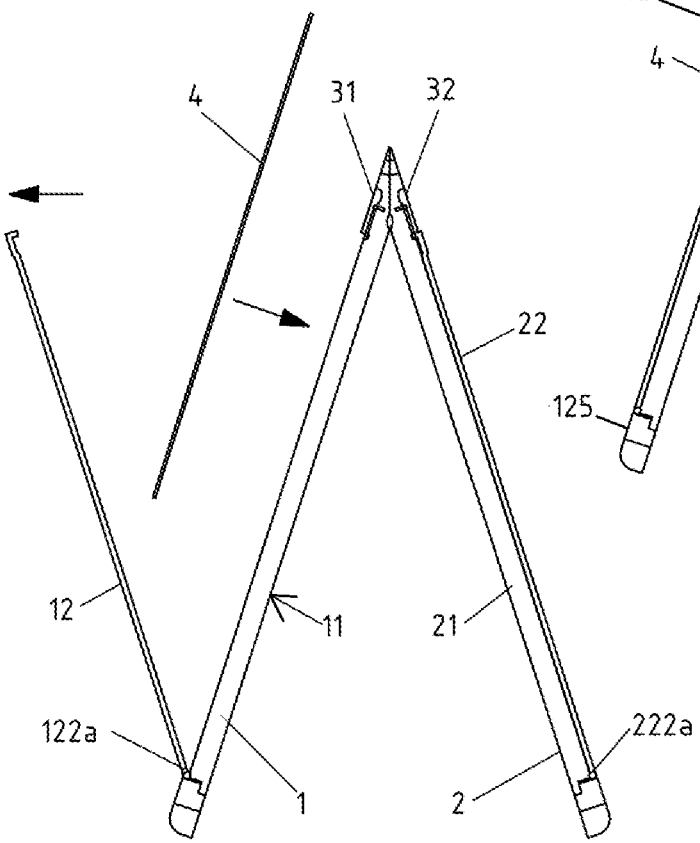
FIG. 2*a* is a side view illustrating a frame stand with an opened cover frame and showing how to insert a poster into the frame stand.
Figure 2B:
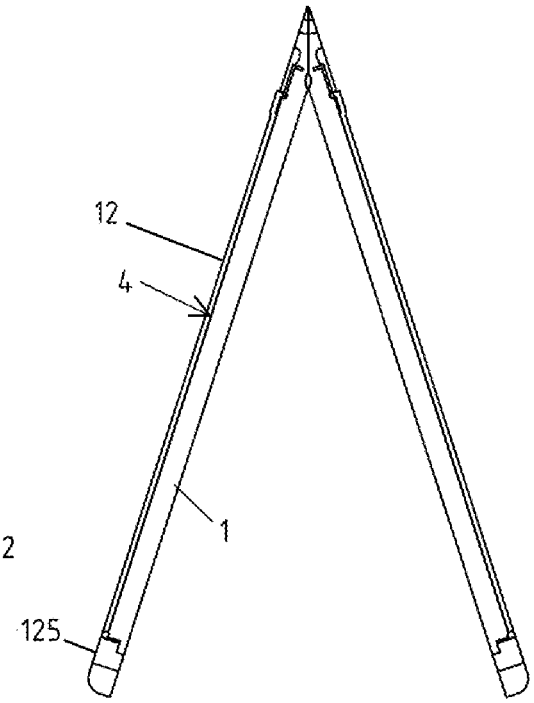
FIG. 2*b* is a side view illustrating a frame stand with closed cover frame.
Figure 2C:
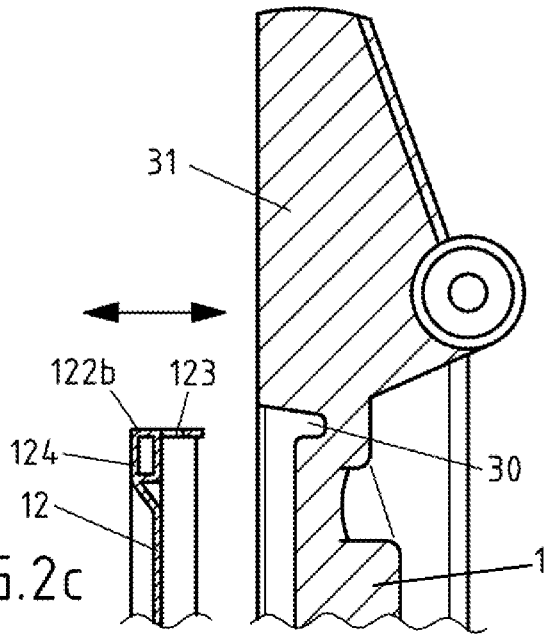
FIG. 2*c* is an enlarged partial cut view illustrating the upper portion of a frame stand.

As presented in FIG. 1 and also in the FIGS. 2*a*-2*c*, the frame 1 includes a base plate 11 and a cover frame 12. Preferably, the cover frame 12 comprises a transparent plate 121 and a peripheral frame 122 surrounding the transparent plate 121. The base plate 11 may be made of plastic, metal, wood or other materials known in the art.

The transparent plate 121 can be made of plastic material like PMMA. As an alternative, a glass plate can be also used as the transparent plate, however, glass is not preferred if the frame stand has to be moved frequently, since the weight of glass is relatively heavy.

The peripheral frame 122 surrounding the transparent plate 121 is preferred to be a metal frame, for example, made of stainless steel, aluminum, or aluminum alloy.

In the invention, the bottom edge 122*a* of the cover frame 12 is rotatable connected to the base plate 11 or the frame 1, so that the cover frame 12 can pivot around an axis located at the bottom part of the base plate 11.

The frame 1 forms a circumferential projection 125 which surrounds the cover frame 12 when the cover frame 12 is in its closed position. Preferably, the outer surfaces of the circumferential projection 125 and the cover frame are flush with each other when the cover frame is in its closed position (see FIG. 2*b*). As an alternative, the circumferential projection 125 stands out against the cover frame 12 when the cover frame 12 is in its closed position. As a result, the cover frame is well-protected in its closed position.

As shown in FIG. 1 as well as in the FIGS. 2*a* and 2*b*, a poster 4 can be inserted into the frame stand.

In a preferred embodiment, the frame 2 has a similar structure compared with the frame 1, namely also comprising a base plate 21 and a cover frame 22, wherein the bottom edge 222*a* of the cover frame 22 is rotatable connected to the base plate 21. An example of this embodiment can be seen in FIG. 2*a*.

FIG. 2*a* illustrates a frame stand with an opened cover frame and showing how to insert a poster 4 into the frame stand.

FIG. 2*b* illustrates a frame stand with closed cover frame.

A process of inserting a poster into the frame stand can be as follows.

Firstly, the cover frame 12 is rotated outwardly, so that the receptacle to receive the poster is open. The cover frame 12 is the in its opened position.

Secondly, the poster 4 is inserted and spread on the base plate 11 of the frame 1.

Thirdly, the cover frame 12 is rotated inwardly. When the upper edge 122*b* of the cover frame 12 comes into contact with the base plate 11, a closed status is achieved. The cover frame is in its closed position.

With a reversed process, the poster therein can be removed or changed.

A preferred embodiment is presented in FIG. 2*c*.

It is preferred that there is a groove 30 in the upper portion of the stand frame. The groove 30 is so arranged that an inner edge 123 of the upper edge 122*b* of the cover frame 12 can be inserted into the groove 30, to keep the cover frame 12 in a closed status and stable position. Further, this embodiment allows locking the cover frame 12 in its closed position in a simple and convenient manner.

In a further preferred embodiment, a locking element is provided to lock the cover frame 12 and the frame 1 together, and thus further restrain the cover frame 12 from rotating.

Preferably, a locking element is capable of locking the upper edge 122*a* of the cover frame 12 with the frame 1. More preferably, the locking element can be moved into a slot of the inner edge 123 for locking the cover frame in a simple and convenient manner.

It is also preferred that there is a stepped profile 124 provided at the outside of the upper edge 122*b* of the cover frame 12. The stepped profile 124 can work as a grip which facilitates opening and closing the cover frame.

Figure 3:
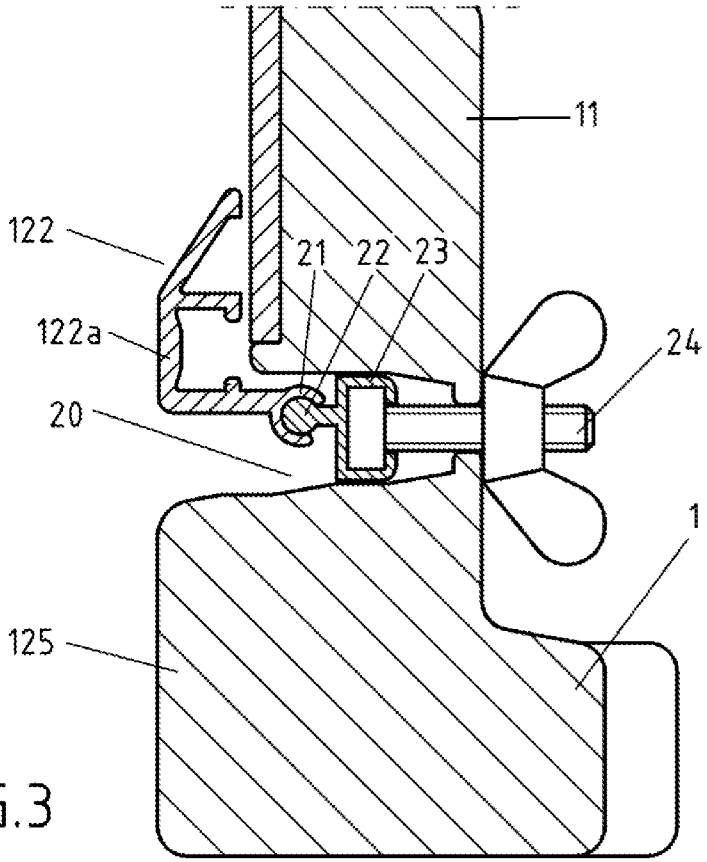
FIG. 3 is an enlarged partial cut view of the lower part of a frame stand, showing an exemplary structure of the pivot portion.

FIG. 3 shows an exemplary structure of the pivot portion to achieve the above function. In FIG. 3, the bottom edge 122*a* of the peripheral frame 122 has an almost rectangular profile so that a female pivoting member 21 is provided at the inner side of the cover frame 12. The female pivoting member 21 matches with the male pivoting member 22 of the bar 23 so that the female pivoting member 21 can pivot around the axis of the male pivoting member 22. The bar 23 is fixed to the base plate 11 respectively the frame 11 by a fastener 24, for example, a screw fastener. As shown in FIG. 3, the bar 23 may have the form of a rail which can hold the fastener 24 in a displaceable manner.

A groove 20 is formed adjacent to the bottom part of the base plate 11, and many components including the bottom edge 122*a*, the female pivoting member 21, the male pivoting member 22, the bar 23, a portion of the fastener 24, etc., are located in the groove 20. These parts are on one side well-protected. On the other side, these parts are nearly invisible.

It is understandable that other alternatives may also apply, for example, that the male pivoting member 22 is an integrated part of the molded base plate 11.

Figure 4A:
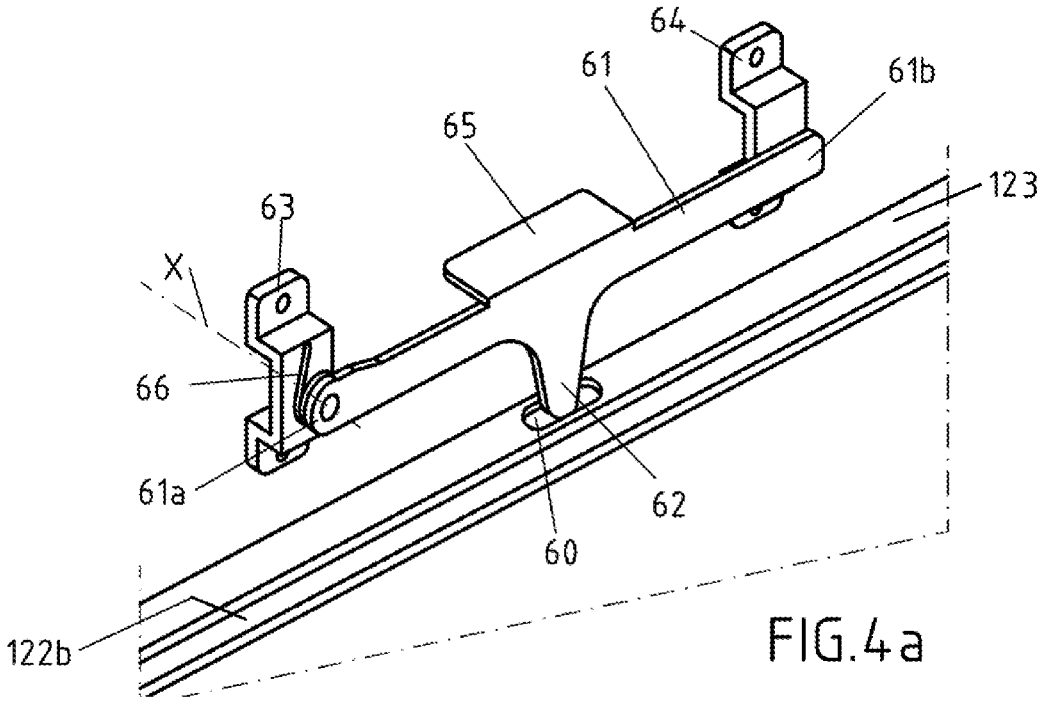
FIG. 4*a* illustrates a preferred embodiment of a locking member.

FIG. 4*a* is an enlarged partial perspective view showing the locking element in the locked position. FIG. 4*a* is an enlarged partial perspective view showing how to unlock the locking mechanism. FIG. 4*c* and FIG. 4*d* are enlarged partial cut views showing the locking element in the unlocked and locked position.

Figure 4B:
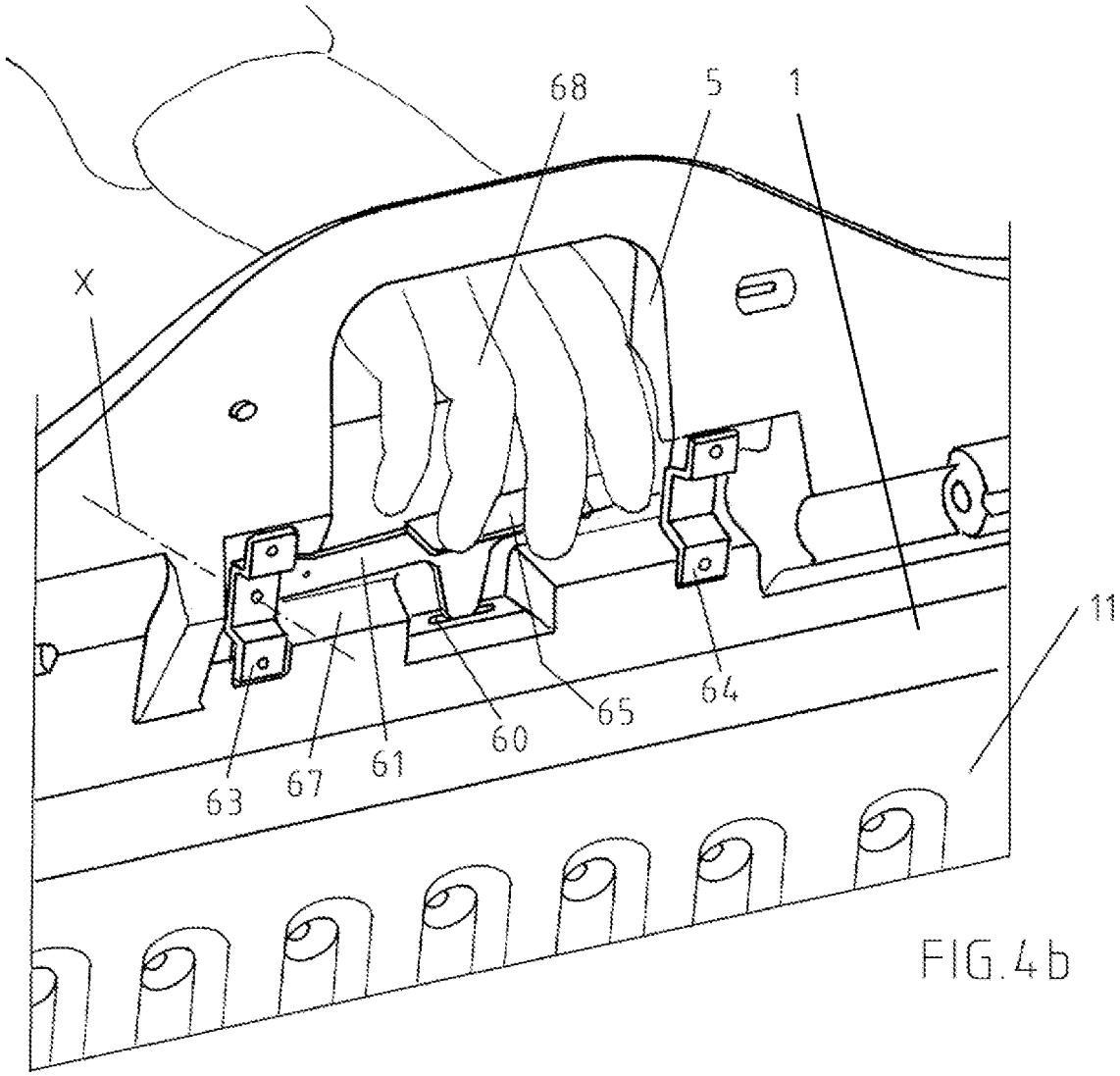
FIG. 4*b* illustrates how a user moves the latch of the locking member.
Figure 4C:
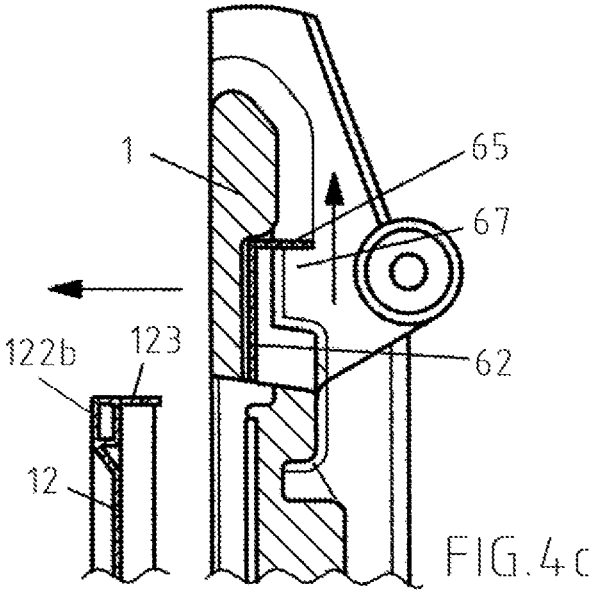
FIG. 4*c* is an enlarged partial cut view showing the locking element in a locked position.
Figure 4D:
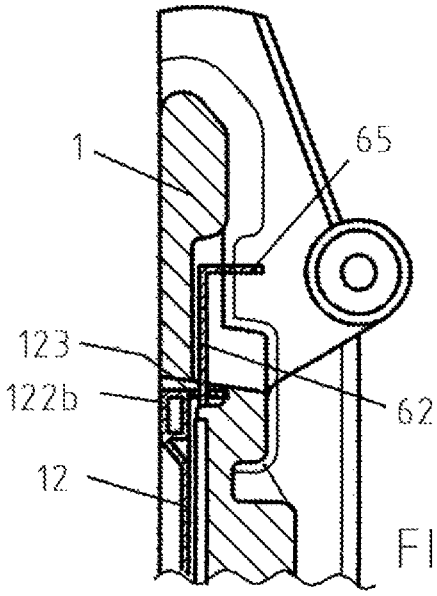
FIG. 4*d* is an enlarged partial cut view showing the locking element in an unlocked position.

FIG. 4*a* to FIG. 4*d* illustrates a preferred embodiment to lock the upper edge 122*a* of the cover frame 12 with the frame 1. On the upper edge 122*b* of the cover frame 12, there is a slot 60. Meanwhile, there is a latch 61 mounted to the frame 1. The latch 61 has a projection 62 so adapted to be inserted into the slot 60 of the cover frame 12. One end 61*a* of the latch 61 is connected to the cover frame 11 through a fastening piece 63, while the other end 61*b* of the latch 61 is free, so that the latch 61 can pivot around the axis X. The frame 1 comprise a groove 67 at its backside adjacent to the hole 5. The latch 61 is placed within the groove 67 so that a user's hand 68 can easily grip for example a grip bar 65 for lifting the latch 61 as shown in FIG. 4*b* by a rotation movement around the axis X.

Preferably, there is a spring 66 mounted behind the end 61*a* of the latch 61. The spring 66 surrounds the axis X and is pre-stressed in such a manner that the latch 61 is kept in a lower position and thereby inserted into the slot 60 if no extra force is applied. Owing to the pre-stressed spring 66, the user has to overcome the spring force for lifting the latch 61 in its unlocked position. In other word, the spring 66 further ensues that the cover frame 12 is kept in a locked status in its closed position.

Preferably, the latch 61 is provided with a grip bar 65, so that the user can grip and move the latch 61 in an easy manner. Preferably, the grip bar 65 and the latch 61 form an angle of 90°. Preferably, the grip bar 65, the latch 61 and the projection 62 are formed from one metal sheet and are thus made in one piece for stability reasons. As an alternative, the grip bar 65, the latch 61 and the projection 62 can be formed from an artificial material.

Optionally, a further restricting piece 64 is also mounted to the base plate 1, but not fastened with the latch 61. The restricting piece 64 just works to restrict the movement range of the latch 61. As presented in FIG. 4*b*, the latch 61 has a free end 61*b* that can move within the space between the base plate 11 and the restricting piece 64. Thereby, the end 61*b* of the latch 61 is limited to move upwardly and downwardly within a defined room.

In a locked position, the projection 62 of the latch 61 is inserted into the slot 60 of the cover frame 12 as shown in the FIGS. 4*a* and 4*d*, and thereby restrains the cover frame 12 from rotating. The above mentioned inner edge 123 comprises the slot 60.

In order to unlock, a user has to push or pull the latch 61 upwardly as illustrated in FIG. 4*b*. In a preferred embodiment as presented in FIG. 4*b*, wherein a hole 5 is provided on the top portion 3 to form a handle for the frame stand, the hole 5 is preferred to be big enough so that a user's hand 68 can pass through the hole 5 to contact respectively to grip the grip bar 65 of the latch 61.

When the user moves the latch 61 upwardly, the projection 62 of the latch 61 is lifted to be away from the slot 60 of the cover frame 12.

As shown in FIG. 4*c*, in the unlocked position, the latch 61, 62, 65 is in a lifted position and the cover frame 12 is able to rotate into its opened position.

In a short word, the user raises the latch 61 to unlock, and drops latch 61 and thus the projection 62 into the slot 60 to lock. If there is a corresponding pre-stressed spring 66 (see FIG. 4*a*), the spring would move the latch 61 into its locked position. In this case, it is not necessary that a user has to drop the latch 61 for locking the locking mechanism comprising the latch 61.

Figure 5:
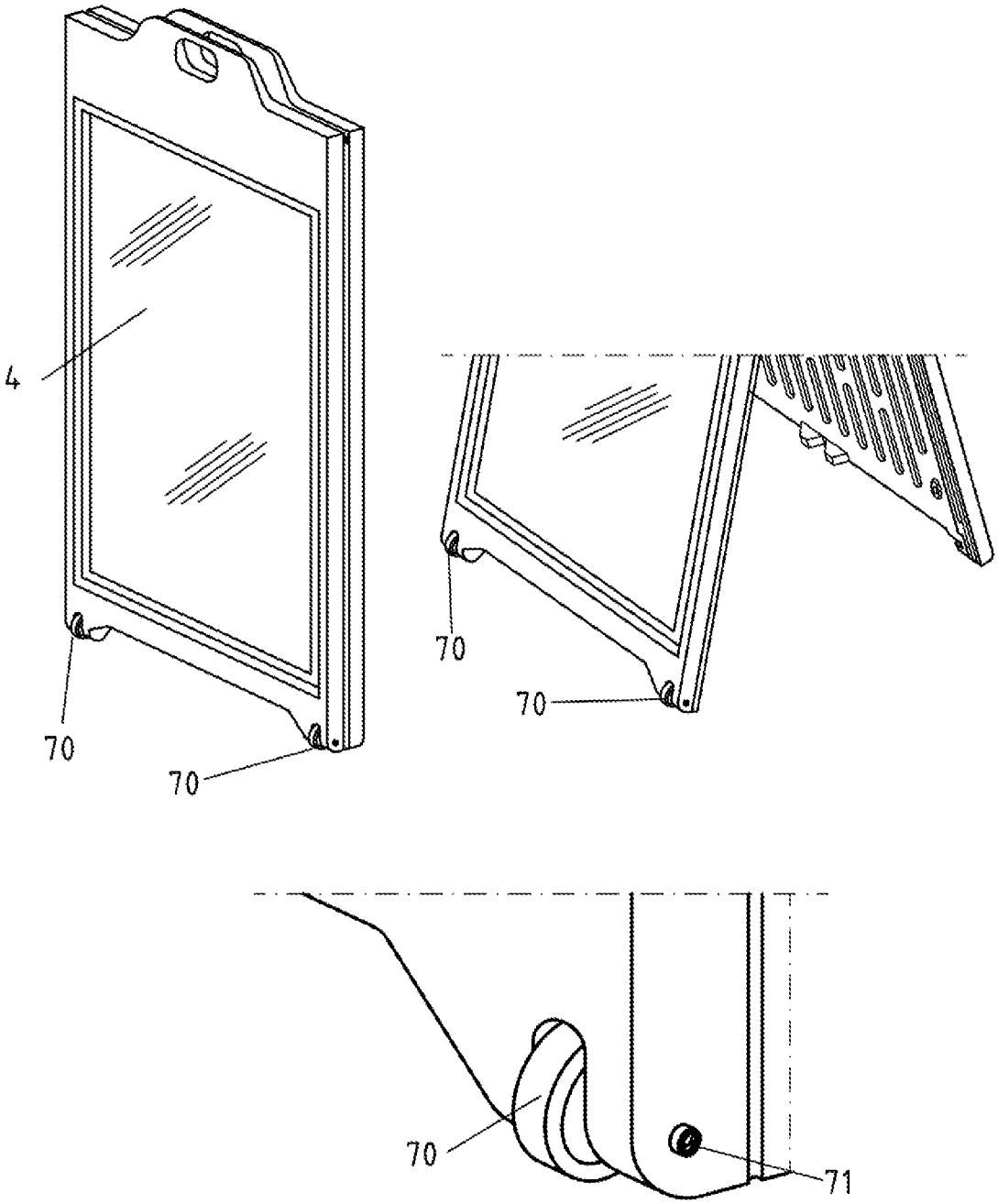
FIG. 5 shows another embodiment of the frame stand with wheels.

FIG. 5 shows another embodiment of the frame stand, wherein some wheels 70, for example, two wheels 70 are provided at the bottom of one base frame 1 or base plate, for example, at the two feet of the frame 1. Owing to the wheels 70, it is much easier to move the folded frame stand from one place to another place. The wheel may be mounted by screws 71.

FIG. 6*a* to FIG. 6*d* show some further embodiments of the frame stand, in order to enhance its stability in deployed status.

Figure 6A:
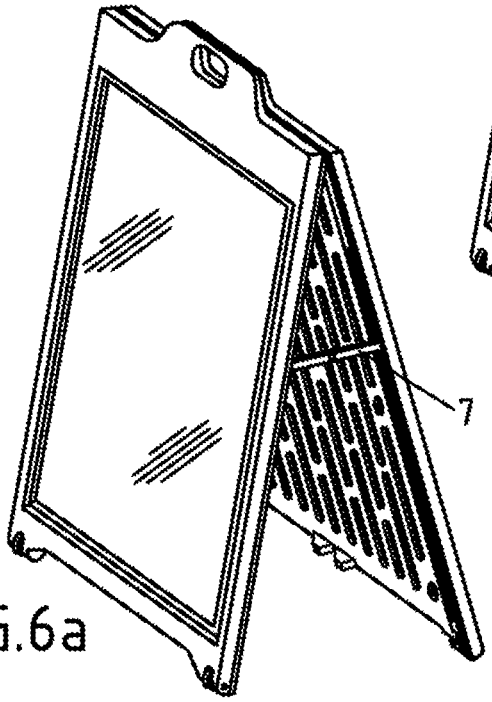
FIG. 6*a* to FIG. 6*d* shows some further embodiments of the frame stand.

In FIG. 6*a*, a foldable band 7, for example comprised of two hinged bars, is applied to one side of the two frames 1 and 2, and connects the two frames 1 and 2, for example, in the middle part of the frames.

Figure 6B:
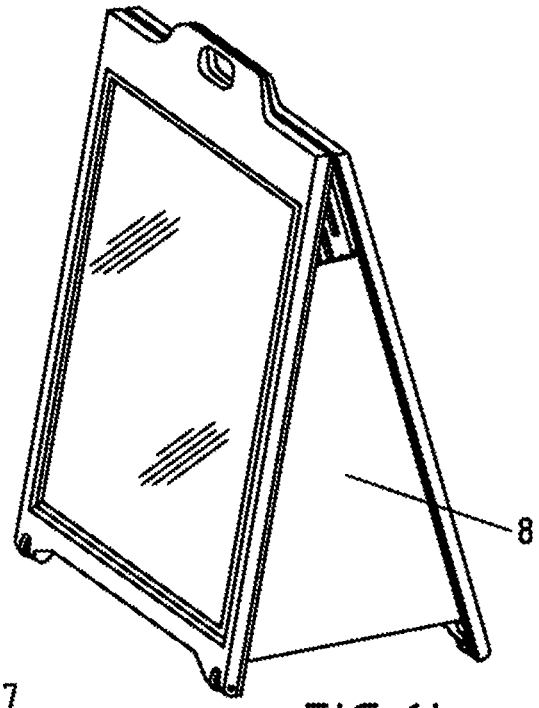

In FIG. 6*b*, side walls 8 are installed between the two frames 1 and 2, after the two frames are deployed.

Figure 6C:
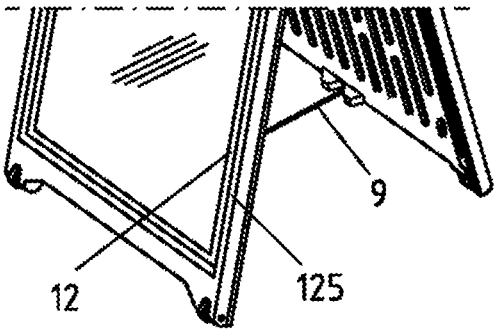

In FIG. 6*c*, a connecting rod 9 is installed between the two frames 1 and 2, at the bottom part of the frames.

Figure 6D:
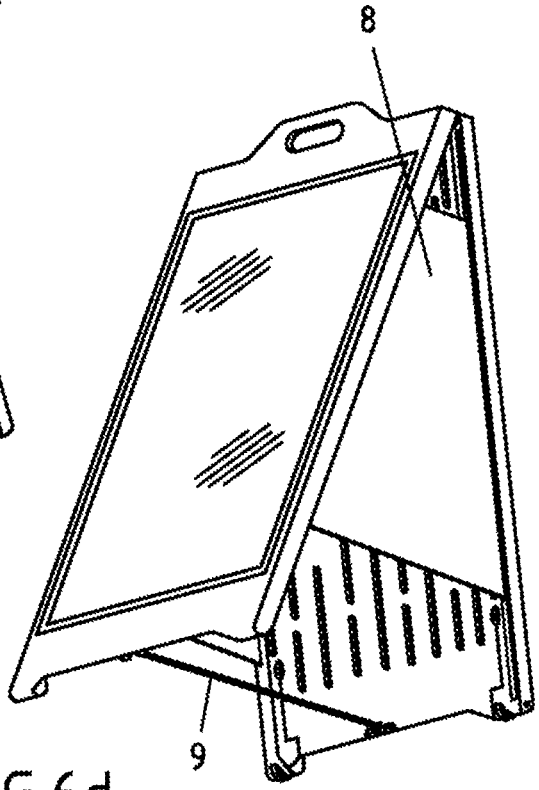

In FIG. 6*d*, both the side walls 8 and the connecting rod 9 are applied.

Due to the special structures of the present invention, our invention has at least following advantages.

Since the cover frame 12 surrounding a transparent plate is provided, inserted posters can be protected from water, dust and wind.

Besides, since the cover frame can be placed in close contact with the base plate 1 respectively plate 11 (especially in the embodiments of FIG. 2*c* and FIG. 4), the posters therein can be stretched over the surface of the cover frame in a taut position, and meanwhile be held in a substantially fixed position.

The opening for inserting a poster is arranged at the upper side of the frame stand, so that the user only has to rotate the cover frame over a small angle, and a small opening is sufficient to remove and to insert a poster.

The bottom edge of the cover frame is connected to the base plate, which forms a V-shape container. Thus, when inserting the poster, the poster can be directly and quickly put into the container without any danger of slipping out.

Thus, a user can finish the manipulation of changing posters in a very easy manner. One hand can handle the poster 4 and the other hand can handle the cover frame 12. There is no need for an of adhesive. The user has not to change his standing position.

FIG. 2*a* and FIG. 2*b* explains how to insert a poster into the frame stand when the frame stand is in deployed status.

As an alternative, the poster therein can also be changed when the frames are in folded flat status. When the frame stand is folded and lie parallel to the ground, various posters having various sizes can be spread on the base plate at one's disposal. When the cover frame is closed, the poster therein is held in a substantially fixed position. Then, the frame stand is ready to be deployed for display.

The stand frame according to our invention is preferred to have an inclined display surface when it is standing on the ground. For example, when it is a V-shape or A-shape fame stand, the display surface generally has an acute angle relative to the ground. When the display surface of the base plate is so inclined, the gravity of the cover frame helps to close the cover frame and helps to keep the frame in a closed state. Furthermore, the gravity of the cover frame helps to press the poster to be in a tauter position. Lastly, when the display surface of the base plate is inclined, the weight of the cover frame can be burden by the base plate, which guarantees the stability and durability of the stand frame.

When a locking element is applied, the frame can be locked to a closed state.

When the locking element is applied on the upper edge of the cover frame, the manipulation is maintained to be simple. One hand unlocks the latch, and the other hand opens the cover frame. The two manipulations occur within a small distance and it is therefore easy to be finished at the same time.

In a preferred embodiment of FIG. 4, a detailed locking element is provided. It can be understood that many other locking element may be also applied. But the embodiment shown in FIG. 4 is specially easy in manipulation, simple in structure, and reliable in repeated use.

As above it provides a disclosure of the preferred embodiments of the invention, but it is not intended to limit the scope of invention to the exact constructions as described. Various modifications, alternative constructions, changes and equivalents, will be readily employed in relevant technical fields directly or indirectly, without departing from the scope of the claims.

The invention claimed is:

1. A frame stand for posters, comprising a base plate (11), a cover frame (12), and a locking mechanism including a locking element, characterized in that the cover frame (12) has a bottom edge (122*a*) which is rotatable connected to the base plate (11), wherein the locking element is provided to lock the cover frame (12) and the base plate (11) together and wherein the locking element comprises a latch (61) which has a projection (21) suitable to be inserted into a slot (60) of an upper edge (122*b*) of the cover frame (12), wherein a groove (30) is provided in an upper portion of the base plate (11), and the groove (30) is so arranged that an inner edge (123) of the upper edge (122*b*) of the cover frame (12) can be inserted into the groove (30).

2. The frame stand according to claim 1, wherein the locking mechanism is located at the top for the cover frame.

3. The frame stand according to claim 2, wherein the locking mechanism is arranged adjacent to a handle of the frame stand.

4. The frame stand according to claim 1, wherein the latch (61) is so mounted to the base plate (11) that one end (61*b*) of the latch (61) is free to move upwardly or downwardly.

5. The frame stand according to claim 1, wherein a hole (5) is provided on a top portion (3) of the base plate (11) to form a handle for the frame stand, and for allowing a user's hand (68) to pass through the hole (5) in order to lift the latch (61).

6. The frame stand according to claim 1, wherein the base plate (11) comprises a circumferential projection (125) which surrounds the cover frame (12) when the cover frame (12) is in its closed position.

7. The frame stand according to claim 1, wherein the cover frame (12) surrounds a transparent plate (121).

8. The frame stand according to claim 1, wherein the base plate (11) has an inclined display surface when the frame stand stands on a ground in the intended manner.

9. The frame stand according to claim 1, wherein the frame stand is a- or a V-shape frame stand, wherein the frame stand further comprises a second base plate.

10. The frame stand according to claim 9, wherein the base plate and the second base plate are connected together by a hinge.

11. The frame stand of claim 10, wherein the base plate and the second base plate are configured to swing out to present an inverted "V".

12. The frame stand according to claim 1, further comprising two top portions (31, 32) which are configured to come into contact and restrain a further increase in an opening angle of the frame stand, so that the opening angle will be kept to be an acute angle.

13. A frame stand for posters, comprising a base plate (11), a cover frame (12), and a locking mechanism including a locking element, characterized in that the cover frame (12) has a bottom edge (122*a*) which is rotatable connected to the base plate (11), wherein the locking element is provided to lock the cover frame (12) and the base plate (11) together and wherein the locking element comprises a latch (61) which has a projection (21) suitable to be inserted into a slot (60) of an upper edge (122*b*) of the cover frame (12), wherein the latch (61) is mounted in a rotatable manner.

14. A frame stand for posters, comprising a base plate (11), a cover frame (12), and a locking mechanism including a locking element, characterized in that the cover frame (12) has a bottom edge (122*a*) which is rotatable connected to the base plate (11), wherein the locking element is provided to lock the cover frame (12) and the base plate (11) together and wherein the locking element comprises a latch (61) which has a projection (21) suitable to be inserted into a slot (60) of an upper edge (122*b*) of the cover frame (12), wherein the locking mechanism is located at the top for the cover frame, wherein the locking mechanism comprises a pre-stressed spring (66) which can move the locking mechanism into its locked position and/or which can hold the locking mechanism in its locked position.

15. The frame stand according to claim 14, wherein the locking mechanism comprises a grip bar (65) which is attached to the latch (61) and bent forward or backward relative to the latch and/or wherein the latch and the grip bar forms angle of 90°.

16. A frame stand for posters, comprising a base plate (11), a cover frame (12) and a locking mechanism at a top of the cover frame, characterized in that the cover frame (12) has a bottom edge (122*a*) which is rotatable connected to the base plate (11), wherein the base plate (11) comprises a groove (67) at the backside adjacent to a hole 5 and wherein a locking element (61, 62, 65) of the locking mechanism is arranged within the groove (67).

17. A frame stand for posters, comprising a base plate (11), a cover frame (12), and a locking mechanism including a locking element, characterized in that the cover frame (12) has a bottom edge (122*a*) which is rotatable connected to the base plate (11), wherein the locking element is provided to lock the cover frame (12) and the base plate (11) together and wherein the locking element comprises a latch (61) which has a projection (21) suitable to be inserted into a slot (60) of an upper edge (122*b*) of the cover frame (12), wherein the locking mechanism is located at the top for the cover frame, further comprising a restricting piece (64) which restricts the movement of the latch (61) of the locking mechanism and which is attached at a backside of the base plate (1).

* * * * *